United States Patent [19]

Dreyer

[11] Patent Number: 4,557,546

[45] Date of Patent: Dec. 10, 1985

[54] SOLDERLESS COAXIAL CONNECTOR

[75] Inventor: Charles W. Dreyer, Fairfield, Conn.

[73] Assignee: Sealectro Corporation, Mamaroneck, N.Y.

[21] Appl. No.: 523,861

[22] Filed: Aug. 18, 1983

[51] Int. Cl.[4] ..... H01R 17/18

[52] U.S. Cl. ..... 339/177 R; 339/89 C

[58] Field of Search ..... 339/177, 89 C, 90 C

[56] References Cited

U.S. PATENT DOCUMENTS

| | | | |
|---|---|---|---|
| 3,184,706 | 5/1965 | Atkins | 339/177 R |
| 3,526,871 | 9/1970 | Hobart | 339/177 E |
| 3,544,705 | 12/1970 | Winston | 174/75 |
| 3,757,279 | 9/1973 | Winston | 339/177 R |
| 4,441,781 | 4/1984 | Forney et al. | 339/177 R |

FOREIGN PATENT DOCUMENTS

| | | | |
|---|---|---|---|
| 912672 | 10/1972 | Canada | 339/177 R |
| 1540617 | 1/1970 | Fed. Rep. of Germany | 339/177 R |
| 1958357 | 6/1970 | Fed. Rep. of Germany | 339/177 R |
| 2703306 | 8/1977 | Fed. Rep. of Germany | 38/1 |
| 2089878 | 1/1972 | France . | |
| 2224894 | 10/1974 | France . | |
| 387524 | 3/1933 | United Kingdom | 38/1 |
| 928336 | 12/1959 | United Kingdom | 38/1 |
| 829769 | 3/1960 | United Kingdom . | |
| 832186 | 4/1960 | United Kingdom . | |
| 1306653 | 2/1973 | United Kingdom | 38/1 |
| 1400362 | 7/1975 | United Kingdom . | |
| 1452346 | 10/1976 | United Kingdom . | |

*Primary Examiner*—Gil Weidenfeld
*Assistant Examiner*—David L. Pirlot
*Attorney, Agent, or Firm*—Anthony J. Casella; Gerald E. Hespos

[57] ABSTRACT

An assembly is provided for releasably joining a semi-rigid coaxial cable to a coaxial connector. The assembly includes an outer clamping sleeve which slides over and compresses an inner clamping sleeve against the cable. A coupling nut is threaded onto the coaxial connector and urges the inner and outer clamping sleeves into telescoping relationship, thus compressing the inner clamping sleeve against the cable. The inner clamping sleeve includes slots to facilitate compression and grooves to facilitate clamping of the cable.

6 Claims, 6 Drawing Figures

SOLDERLESS COAXIAL CONNECTOR

BACKGROUND OF THE INVENTION

Coaxial cables comprise an inner conductor, an outer conductor concentrically disposed around the inner conductor and a non-conducting insulation uniformly disposed therebetween. The cables may or may not include an outer insulation. Coaxial cables are used in many applications where it is necessary to carry radio frequency or microwave frequency electric signals.

Coaxial cables must maintain their symmetry while in use. Variations in coaxial symmetry can create an impedence or a phase shift which can have a substantial degrading effect on the electric signal carried by the cable. To maintain symmetry at an electrical connection, the ends of the coaxial cable typically are joined to coaxial cable connectors which are designed to have a minimum effect on the signal. Coaxial cable connectors may be used to join one cable to another or to join a coaxial cable to an electrical device.

One particular type of coaxial cable includes a center conductor, a symmetrical insulation, such as Teflon, surrounding the center conductor, and a semi-rigid tubular outer conductor, with no insulation extending around the tubular outer conductor. These semi-rigid tubular outer conductor coaxial cables can be joined to coaxial cable connectors by soldering. Although soldered connections are widely used, they present several significant problems. Specifically to make the soldered connection, both the tubular outer conductor and the connector must be heated sufficiently to cause the solder to melt and wick into the area between the two members. This heat causes the insulation to expand, and the expansion can, in turn, cause a permanent deformation of the tubular outer conductor, with a resultant detrimental effect on the signal-carrying performance of the coaxial cable. In extreme instances the heat generated to melt the solder can damage nearby electrical components.

Solderless connectors for tubular outer conductor coaxial cables avoid problems attributable to soldering heat. However, solderless connectors have required a mechanical deformation of the outer conductor. For example, the cable may be inserted into a bushing or sleeve which then is placed in a special tool which crimps both the sleeve and the cable sufficiently to mechanically interengage the two. The crimped sleeve then can be force fit into another part of the connector. This deformation of the outer conductor has a substantial effect on the signal carried by the cable. If the connector is to be used in an environment with severe temperature, shock and vibration conditions, the size of the crimp must be further increased with an even greater degrading effect on electrical performance.

Other solderless coaxial connectors have been developed which rely on compression rather than crimping. However, the net effect is the same in that the geometry changes with a resultant effect on electrical performance. Both the crimping and compression solderless connectors require special tools to mechanically deform the outer conductor of the cable. These tools typically are quite expensive, and if not used properly can twist and permanently damage the cable. Additionally, crimping, compression and soldering all are permanent connections. Thus it is difficult or impossible to disconnect, shorten and reconnect the cable in order to achieve a desired precise phase length.

In view of the above it is an object of the subject invention to provide a connector for tubular outer conductor coaxial cables which does not require soldering or other application of heat to the cable or the connector.

It is another object of the subject invention to provide a solderless connector for tubular outer conductor coaxial cables which does not require special tools and can be connected by hand or with a standard wrench.

It is an additional object of the subject invention to provide a solderless connector for tubular outer conductor coaxial cables which does significantly affect the electrical performance at radio frequency or microwave frequency.

It is a further object of the subject invention to provide a solderless connector for tubular outer conductor coaxial cables which does not crimp or otherwise substantially deform the cable.

It is yet another object of the subject invention to provide a solderless connector for tubular outer conductor coaxial cables which can be easily disconnected and reconnected.

It is yet an additional object of the subject invention to provide a solderless connector for tubular outer conductor coaxial cables which can be employed under severe conditions of temperature, shock, and vibration.

SUMMARY OF THE INVENTION

The solderless connector of the subject invention includes a generally cylindrical inner clamping sleeve which is telescopingly slid over one end of a tubular outer conductor coaxial cable, and is compressed radially inwardly into secure engagement with the outer conductor by an outer clamping sleeve. More particularly the inner clamping sleeve includes one end which is chamferred to an angle of approximately 30° with respect to the longitudinal axis. The chamfer thus defines major and minor outer diameters. In one embodiment the opposed end of the inner clamping sleeve includes a circumferential stop with a diameter less than the diameter of the coaxial cable. As a result, the inner clamping sleeve can be mounted on one end of the coaxial cable, but will not slide along the length of the cable.

The inside surface of the inner clamping sleeve is roughened from a point substantially adjacent the chamfer to a point at least intermediate the two ends of the inner clamping sleeve. Preferably this roughening is in the form of a series of parallel annular grooves. Other irregular roughening also can be used, as can standard helical threads. However, it has been found that with helical threads there is possibility of the inner clamping sleeve twisting off the coaxial cable on which it is mounted when used in high vibration environments.

To further facilitate the radial compression of the inner clamping sleeve, at least one slit is provided in the sleeve. The slit may be aligned either parallel to the longitudinal axis of the inner clamping sleeve, or arranged at an angle thereto. Preferably the inner clamping sleeve includes a pair of slots aligned at an angle to the longitudinal axis of between 10° and 60°. The width of the slot should be sufficient to enable both a clamping compression of the inner clamping sleeve and a slight deformation of the tubular outer conductor into the slot.

The outer clamping sleeve also is generally cylindrical, and has an inside diameter which is less than the major diameter of the chamfer on the inner clamping sleeve, but greater than the minor diameter. Thus, when the inner and outer clamping sleeves are moved toward one another, the outer clamping sleeve slides over the chamfer, and compresses the inner clamping sleeve into clamping engagement with the tubular outer conductor of the coaxial cable. As an alternative to the above, the chamfer may be on the inner surface of the outer clamping sleeve.

To achieve the interengagement of the inner and outer clamping sleeves, a coupling nut is used in combination with a standard coaxial connector. One end of the coupling nut has internal threads for engagement with the coaxial connector, while the other end is adapted to retain the outer locking sleeve. Preferably the outer clamping sleeve is retained in the coupling nut by a locking ring which enables the outer clamping sleeve to rotate, but limits longitudinal movement. Thus, the outer clamping sleeve will not rotate as the coupling nut is threaded onto the coaxial connector, thereby minimizing friction as the inner and outer clamping sleeves are telescopingly nested. In an alternate embodiment the coupling nut and outer clamping sleeve may be an integral member.

Prior to mounting the subject connector to the coaxial cable, the cable preferably is trimmed such that the center conductor extends longitudinally beyond the insulation and the tubular outer conductor. It is also preferred that the center conductor be trimmed to a well defined point to further facilitate coupling. The trimmed center conductor then is inserted into the center conductor socket on the coaxial cable connector.

In use, the coupling nut is slid over the tubular outer conductor coaxial cable such that the threaded end of the coupling nut is nearest the trimmed end of coaxial cable. The inner clamping sleeve then is slid over the end of the coaxial cable such that the end thereof having the slots and the chamfer is nearest the coupling nut. The coupling nut then is threadably attached to the coaxial connector. As the coupling nut axially advances toward the connector the inner and outer clamping sleeves also advance toward one another such that the outer clamping sleeve is at least partially telescopingly received over the chamfered end of the inner clamping sleeve. This telescoping relationship between the inner and outer clamping sleeves causes the roughened inner surface of the inner clamping sleeve to be pressed inwardly against the tubular outer conductor. Although hand tightening of the coupling nut provides a sufficient clamping inter-engagement for most functions, it is preferred that the coupling nut be securely tightened with a wrench. Tightening of the coupling nut with a wrench causes at least a minor deformation of the tubular outer conductor into the slot, which contributes to symmetry and thus improve performance at high frequencies.

DETAILED DESCRIPTION OF THE PREFERRED EMBODIMENT

Figure 1:
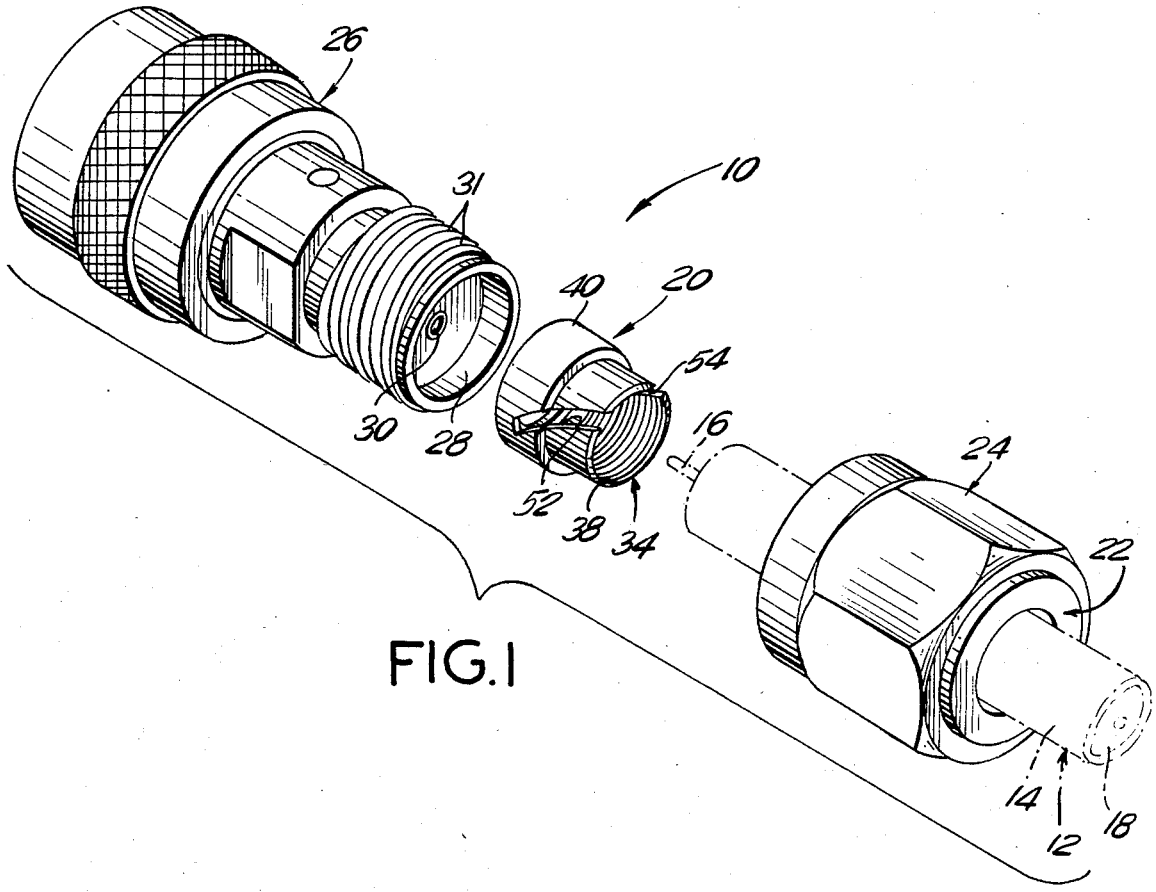
FIG. 1 is an exploded perspective view of the solderless connector of the subject invention.

The solderless connector of the subject invention is indicated generally by the numeral 10 in FIG. 1. More particularly the solderless connector 10 is constructed to be securely mounted on a semi-rigid tubular outer conductor coaxial cable 12. The coaxial cable 12 includes a tubular outer conductor 14 and a center conductor 16 which are coaxially disposed with respect to one another, and are separated by an insulator 18, such as Teflon. Preferably, the coaxial cable 12 is prepared for use with the subject solderless connector 10 by stripping the outer conductor 14 and insulation 18 away from the center conductor 16, and sharpening the stripped end of the center conductor 16.

The solderless connector 10 includes an inner clamping sleeve 20, an outer clamping sleeve 22 and a coupling nut 24 adapted for use with a coaxial connector 26. The coaxial connector 26 includes an outer socket 28 for electrically contacting the tubular outer conductor 14 and an inner socket 30 for electrically contacting the center conductor 16. Threads 31 are disposed around the outside of the outer socket 31 as shown in FIG. 1, and as explained in greater detail below the outer clamping sleeve 22 is mounted in the coupling nut 24 so as to be rotationally moveable therein, while having relative longitudinal movement between the outer clamping sleeve 22 and the coupling nut 24 limited. Additionally, both the inner and outer clamping sleeves 20 and 22 are dimensioned to telescopingly slide onto the coaxial cable 12 and to at least partially telescopingly nest within one another.

Figure 2:
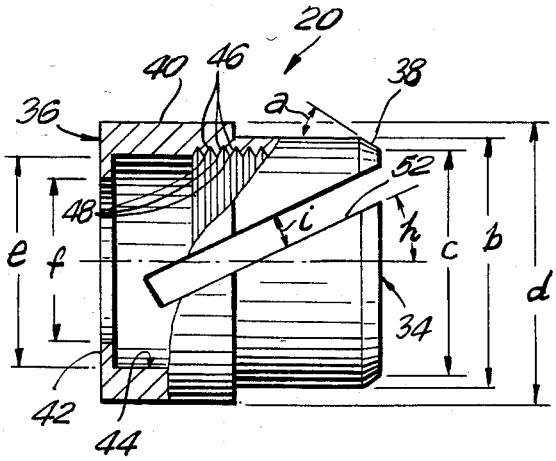
FIG. 2 is a cross-sectional side view of the inner clamping sleeve of the solderless connector shown in FIG. 1.
Figure 3:
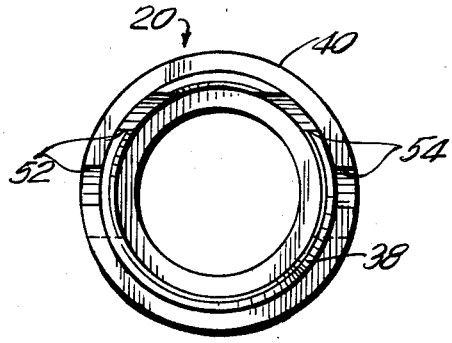
FIG. 3 is an end view of the inner clamping sleeve of the solderless connector shown in FIG. 1.
Figure 4:
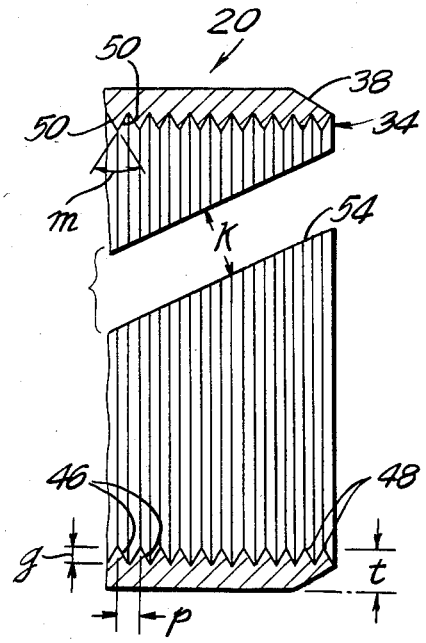
FIG. 4 is a second cross-sectional view of the inner clamping sleeve of the solderless connector shown in FIG. 1.

The inner clamping sleeve 20, as illustrated most clearly in FIGS. 2 through 4, is generally cylindrical, and includes opposed clamping and connecting ends 34 and 36. The clamping end 34 is defined by a chamfer 38 which extends circumferentially around the inner clamping sleeve 20. Preferably the chamfer is formed with an angle "a" of approximately 30°. Thus the chamfer 38 defines a major diameter "b" and a minor diameter "c" at the clamping end 34 of inner clamping sleeve 20. The inner clamping sleeve 20 is sufficiently thin at the clamping end 34 to be readily compressed radially inward against the coaxial cable 12. Specifically the material at the clamping end 34 preferably should be about 0.010 inches thick, as shown by dimension "t" in FIG. 4.

The connecting end 36 of the inner clamping sleeve 20 is defined by an enlarged collar 40 and a circumferential ledge 42. The outside diameter "d" of the collar 40 is substantially equal to the inside diameter of the outer socket 28 on coaxial connector 26. The greater thickness adjacent collar 40 substantially prevents deformation of the connecting end 36 as a result of compression at clamping end 34 and also defines a limit for the telescoping between the inner and outer clamping sleeves 20 and 22. The inside diameter "e" of the inner clamping sleeve 20 is substantially equal to the diameter of the coaxial cable 12. Additionally, the inner diameter "f"

defined by the ledge 42 is less than the diameter of the coaxial cable 12. As a result of this construction the clamping end 34 may be slid over the stripped end of the coaxial cable 12. However the ledge 42 effectively stops the inner clamping sleeve 20 from sliding along the length of the coaxial cable 12. Furthermore, the above defined dimensions ensure that the coaxial cable 12 and the inner clamping sleeve 20 may be slid into the connector 26 without affecting the electrical signal.

The inner surface 44 of the inner clamping sleeve 20 is defined by a plurality of substantially parallel grooves 46 and clamping ridges 48. Preferably each groove 46 has a depth "g" 0.0040 inches plus or minus 0.0005 inches. The grooves 46 and ridges 48 each are defined by intersecting planar surfaces 50 which are separated from one another by angle "m" shown in FIG. 4, which is approximately 60°. Also as shown in FIG. 4, adjacent ridges 48 are separated from one another by distance "p" which is approximately equal to 0.005 inches. As explained further herein, the clamping ridges 48 enable secure clamping with the outer tubular conductor 14 of the coaxial cable 12.

The inner clamping sleeve 20 further includes a pair of slots 52 and 54 which extend angularly through the inner clamping sleeve 20, from the clamping end 34 to a point intermediate the two ends of the inner clamping sleeve 20. Preferably, the slots 52 and 54 extend to a point beyond the clamping ridges 48 and the collar 40. The slots 52 and 54 are provided to facilitate the radially inward compression of the clamping end 34 against the coaxial cable 12, thus enabling the clamping ridges 48 to securely grasp the outer conductor 14.

The angle "h" between slots 52 and 54 and the longitudinal axis of the inner clamping sleeve 20 preferably is between 10° and 60°, with the precise angle being at least partly dependent upon the diameter of the coaxial cable 12 with which the subject inner clamping sleeve 20 is used. Specifically, the angle "h" preferably is greater for a larger diameter coaxial cable 12. As an example on a 0.085 inch cable, the angle "h" preferably is approximately 20°. For a 0.141 inch cable, the angle "h" is preferably about 25°.

The width of slots 52 and 54, as indicated by dimension "i", also preferably varies directly with the size of the cable 12. For example the 0.085 inch cable preferably will include a slot having a width of 0.020 inches, while a 0.141 inch diameter cable preferably will be used with an inner clamping 20 having slots 52 and 54 with a width of 0.025 inches. In all instances, the width of slots 52 and 54 should be sufficient to enable slight deformation of the outer tubular conductor 14 into the slots 52 and 54. This deformation both enhances the gripping power of the inner clamping sleeve 20 and minimizes the degradation of the electric signal carried through the solderless connection 10.

Figure 5:
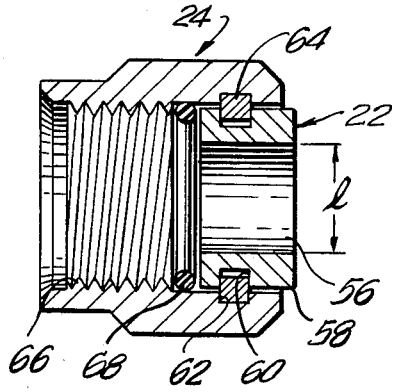
FIG. 5 is a cross-sectional view of the coupling nut and outer clamping sleeve of the solderless connector shown in FIG. 1.

Turning to FIG. 5 the outer clamping sleeve 22 and the coupling nut 24 are shown in their interlocked condition. The outer clamping sleeve 22 includes an inner cylindrical surface 56 which defines a diameter "1" which is greater than the minor diameter "c" but less than the major diameter "b" defined by the chamfer 38 on the inner clamping sleeve 20. As explained below, these dimensional relationships enable the outer clamping sleeve 22 to slide over the chamfer 38 on the inner clamping sleeve 20, thereby compressing the clamping end 34 of the inner clamping sleeve 20 inwardly.

The outer cylindrical surface 58 of the outer clamping sleeve 22 includes an annular notch 60. A similar notch 62 is disposed on the inner surface of the coupling nut 24. Locking ring 64 is disposed in the notches 62 and 64 to substantially prevent longitudinal movement of the outer clamping sleeve 22 with respect to the coupling nut 24. The fit between the locking ring 64 and the notches 60 and 62 is sufficiently loose to enable the outer locking sleeve 22 to rotate freely within the coupling nut 24. The coupling nut 24 further includes an array of internal threads 66 which are adapted to engage the external threads 31 on the coaxial connector 26. An O-ring is disposed in the coupling nut 24 intermediate the outer clamping sleeve 22 and the threads 66. The O-ring 68 prevents penetration by moisture.

Figure 6:
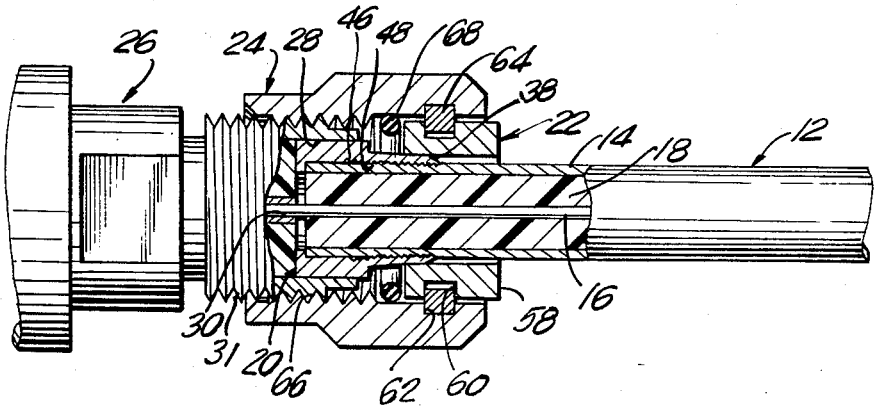
FIG. 6 is a cross-sectional view of the assembled solderless connector shown in FIG. 1.

The solderless connector 10 is assembled into clamping engagement with the coaxial cable 12 as shown in FIGS. 1 and 6 by first sliding the combined outer clamping sleeve 22 and coupling nut 24 over the end of the coaxial cable 12 which has been stripped as described above. More particularly, the combined outer clamping sleeve 22 and coupling nut 24 are slid onto the coaxial cable 12 such that the outer clamping sleeve 22 is most distant from the stripped end of the coaxial cable 12.

The inner clamping sleeve next is slid over the stripped end of the coaxial cable 12, and is moved longitudinally and telescopingly along coaxial cable 12 until the ledge 42 contacts the tubular outer conductor 14 and the insulation 18 of coaxial cable 12.

The coaxial cable 12 then is inserted into the coaxial connector 26 such that the center conductor 16 adjacent the stripped end of the coaxial cable 12 enters the center socket 30 on the coaxial connector 26. This longitudinal movement of the coaxial cable 12 and coaxial connector 26 toward one another also causes the collar 40 of the inner clamping sleeve 20 to enter the outer socket 28. The solderless connector 10 is fastened into this connected condition by first advancing the coupling nut 24 longitudinally over the end 34 of the inner clamping sleeve 20 and threadably engaging the threads 66 of coupling nut 24 with the threads 31 of the coaxial connector 26. As the coupling nut 24 is tightened on into the coaxial connector 26 the outer clamping sleeve 22 contact the chamfer 38 of the inner clamping sleeve 20. Continued movement of the outer coupling sleeve 22 toward and along the chamfer 38 of the inner clamping sleeve 20 causes a progressive inward compression of the inner clamping sleeve 20. This compression is facilitated by the slots 52 and 54. In this regard, it is noted that the angular alignment of slots 52 and 54 with respect to the longitudinal axis substantially ensures a compression of the inner coupling sleeve 20.

As the inner clamping sleeve 20 is compressed inwardly the ridges 48 are urged into contact with the tubular outer conductor 14 of the coaxial cable 12. This radially inward force imposed by the ridges 48 substantially prevents the coaxial cable 12 from being slipped out of engagement with the inner and outer clamping sleeves 20 and 24. Simultaneously the locking ring 64 and the socket 28 of the coaxial connector 26 substantially eliminate any possibility of the inner and outer clamping sleeves 20 and 22 being slid out of engagement with either the coaxial connector 26 or the coupling nut 24. Furthermore the threaded connection between the coupling nut 24 and the coaxial connector 26 substantially eliminates any possibility of the coupling nut 24 and the coaxial connector 26 from being separated from one another. Thus it is seen that the various members of the solderless connector 10 cooperate with one another to ensure a good electrical connection under virtually all operating conditions.

In many instances hand tightening of the coupling nut 24 onto the coaxial connector 26 is sufficient. However in many environments and for high frequency signals, it is desirable to utilize a wrench to mechanically tighten the coupling nut 24. As noted above, this tightening of coupling nut 24 causes a slight deformation of the tubular outer conductor 14 into the slot 52 and 54, thereby contributing to both the mechanical strength and the electrical quality of the connection.

It has been found that when the solderless connector 10 is employed as described above in connection with 0.141 inch diameter semi-rigid coaxial cable, the connection withstands a pull test of approximately 125 lbs. Similarly when the solderless connector 10 is employed with semi-rigid coaxial cable having a diameter of 0.085 inches, the connection can withstand a pull test of approximately 100 lbs. In addition to these mechanical strength characteristics of the connection, it has been found that the connection is able to meet most relevant U.S. military specifications for electrical performance.

In summary, a solderless electrical connector is provided which enables inner and outer clamping sleeves to be partially telescopingly nested within one another such that the inner clamping sleeve is compressed inwardly into secure engagement with the coaxial cable. The inner and outer clamping sleeves are generally cylindrical in construction. The inner clamping sleeve includes a chamfered clamping end which is dimensioned to facilitate the initial telescoping entry into the outer clamping sleeve. Compression of the inner clamping is further facilitated by at least one slot which preferably is angularly aligned with respect to the longitudinal axis. The outer clamping sleeve is mounted in a coupling nut such that rotation is permitted, but longitudinal movement is restricted. The combined coupling nut and outer clamping sleeve are first placed onto an end of the coaxial cable such that the end of the coupling nut having the outer clamping sleeve furthest away from the end of the coaxial cable to be connected. The inner clamping sleeve then is slid unto the coaxial cable such that the chamfer is nearest the coupling nut. The coaxial cable then is inserted into the coaxial connector and the coupling nut and coaxial cable are threadably connected to one another. This threadably connection advances the outer clamping sleeve over the chamfer of the inner clamping sleeve causing the inner clamping sleeve to be compressed into clamping engagement with the coaxial cable.

While the subject invention has described and shown with respect to a preferred embodiment, it is understood that the invention should only be limited by the scope of the attached claims.

What is claimed is:

1. An assembly for releasably joining one end of a semi-rigid coaxial cable to a coaxial connector, said coaxial connector including an array of threads, said assembly comprising:

an inner sleeve for mounting generally concentrically around the cable, said inner sleeve including generally cylindrical inner and outer surfaces and oppose clamping and connecting ends, the diameter of said cylindrical inner surface being substantially equal to the diameter of said cable, said cylindrical inner surface including an inwardly extending annular ledge adjacent the connecting end of said inner sleeve for limiting the axial movement of said inner sleeve relative to the cable, said inner cylindrical surface including a plurality of annular grooves extending from said clamping end to a point intermediate said clamping and connecting ends, said plurality of annular grooves defining clamping ridges therebetween, said inner sleeve further including a pair of angularly aligned slots extending from the clamping end thereof to a point intermediate the clamping and connecting ends, said inner sleeve being compressable into secure engagement with the cable adjacent said slots and said clamping ridges of said inner sleeve;

an outer sleeve for telescopingly sliding over the clamping end of the inner sleeve to progressively compress the inner sleeve;

coupling means for threadably engaging the coaxial connector and for limiting movement of the inner and outer sleeves along the cable; and a locking ring mounted intermediate said outer sleeve and said coupling means, said locking ring enabling rotable movement between said outer sleeve and said coupling means but preventing relative axial movement between said outer sleeve and said coupling means.

2. An assembly as in claim 1 wherein said clamping end is chamferred to facilitate the telescoping sliding of said outer sleeve over said inner sleeve.

3. An assembly as in claim 1 wherein each said annular groove has a depth of between approximately 0.0035 inches and 0.0045 inches.

4. An assembly as in claim 1 wherein said slots extend through substantially the entire portion of said inner sleeve on which said grooves are disposed.

5. An assembly as in claim 1 wherein the slots lie in a common plane, and wherein said plane is aligned at an angle of between 10° and 60° with respect to the axis of the inner sleeve.

6. An assembly as in claim 5 wherein said slots are between 0.020 and 0.025 inches wide.

* * * * *